United States Patent [19]

Pearson

[11] Patent Number: 4,574,426

[45] Date of Patent: Mar. 11, 1986

[54] FLUSH DOOR HINGE FOR A CUT-OUT

[75] Inventor: Jonathon C. Pearson, Hope, England

[73] Assignee: Prospec International Limited, Great Britain

[21] Appl. No.: 553,159

[22] Filed: Nov. 18, 1983

Related U.S. Application Data

[63] Continuation of Ser. No. 293,439, Aug. 17, 1981, abandoned, which is a continuation-in-part of Ser. No. 268,212, May 29, 1981, abandoned.

[51] Int. Cl.[4] ..... E05D 5/06

[52] U.S. Cl. ..... 16/389

[58] Field of Search ..... 16/387, 389, 390, 391, 16/392; 49/381, 400

[56] References Cited

U.S. PATENT DOCUMENTS

| | | | |
|---|---|---|---|
| 731,811 | 6/1903 | Pattee | 16/389 |
| 949,866 | 2/1910 | Trotter | 16/392 |
| 1,948,775 | 2/1934 | Teller et al. | 16/392 |
| 3,130,651 | 4/1964 | Werner | 49/400 |

FOREIGN PATENT DOCUMENTS

| | | | |
|---|---|---|---|
| 496219 | 9/1953 | Canada | 16/392 |
| 620567 | 10/1935 | Fed. Rep. of Germany | 16/392 |
| 2739939 | 3/1979 | Fed. Rep. of Germany | 16/390 |
| 2003 | of 1892 | United Kingdom | 16/392 |
| 1329711 | 9/1973 | United Kingdom | 16/392 |

*Primary Examiner*—Fred A. Silverberg

*Attorney, Agent, or Firm*—Brooks & Kushman

[57] ABSTRACT

A door hinge, especially suitable for use with doors forming part of the playing surface of an indoor games court, comprises a first portion 3 to be fitted to a door 23, a second portion 5 to be fitted to a wall 10 adjacent to the door 23, the first and second portions 3 and 5 being pivotally connected by, for instance, a pin 7, a third portion 17 integral with the second portion 5 and connectable to a wall support member 12 extending at one side of the wall from the plane of the wall 10, with the hinge 1 being mountable on the one side of the wall 10 and door 23 so as not to extend beyond the surfaces of the door 23 and wall 10 on the other side of the wall.

9 Claims, 4 Drawing Figures

FLUSH DOOR HINGE FOR A CUT-OUT

This application is a continuation, of application Ser. No. 293,439, filed 08-17-81, which is continuation-in-part of U.S. Ser. No. 268,212 filed May 29, 1981 both of which are now abandoned.

This invention relates to door hinges and pivots, especially door hinges for use in indoor and outdoor games courts, such as squash or racquet ball courts.

In walled games courts at least one wall may include a door which forms part of the playing surface. For example, a games court, whether indoor or outdoor, may include a door made of glass which forms part of the rear wall of the court, the remainder of the wall also being made of glass. If the door hinges project beyond the surface of the door they would constitute a hazard to the players and also prevent the ball rebounding from the door hinge area in a predictable manner.

A known door hinge for such a door is mounted for pivotal movement about pins located at the top and bottom of the door on a vertical pivot line which is set in from one edge of the door. However, provision of a bottom pivot pin means that the fitting of the door must be done in conjunction with the laying of the floor in order that the mounting for the pivot pin is securely fixed to the floor. This may be inconvenient and time-consuming. Furthermore the door is supported only at the top and at the bottom. If a force is applied to the door, for instance as a result of a player colliding with the door, it is possible for the door to bend between its hinges. Should the player's fingers be inadvertently inserted into the resultant gap during the collision of the player with the door, then when the door returns to its original condition the fingers may be trapped causing injury thereto.

A door of smaller height, and hence a smaller distance between the hinges, may be provided in order to avoid this flexing effect. However a reduced height door is inconvenient for tall players and also may mean that a transom or small section of wall has to be fitted above the door to bring the wall to its full, desired height above the door.

Another known hinge for use in games courts with a glass wall is similar to a conventional door hinge. It is fitted to the edge of the door and has a pivotal axis in the plane of the door and very close to the hinged edge of the door to enable the door to open inwards with the hinged mechanism on the outside of the court. However the use of such hinges results in the whole of the door swinging into the court when the door is open whereas the first mentioned known hinge, which is set in from one edge of the door, allows a "heel portion" of the door to swing outwardly while the main portion of the door is being opened into the interior of the court. With the first mentioned known hinge a door stop can be positioned on the floor outside the court against which the heel portion of the door will abut thereby limiting the swing of the door to say 90°. However where the door hinges are provided at the very edge of the door then the swing of the door must be limited in some other way since it would not be appropriate to position a door stop in the court itself. A rubber stop may be located on the hinge itself, but this requires location on the inside of the court and, when struck by the ball, would affect its direction and/or speed of movement. Alternatively, some form of pneumatic or hydraulic arrangement may be connected between the door and the surrounding glass wall but this involves the use of a more complicated mechanism together with the need for separate fixing of such mechanism to the door and the surrounding wall.

A further disadvantage of the second known door hinge is that such a hinge has hitherto not been capable of withstanding sudden large force applied thereto, for instance, as might arise from the collision of a heavy player striking the door at speed. If such an event occurs then it is possible for the hinges to burst away from the wall.

According to the present invention there is provided a door hinge comprising a first portion to be fitted to a door, a second portion to be fitted to a wall adjacent to such door, said second portion being pivotally connected to said first portion, a third portion integral with said second portion and connectable to a wall support member extending at one side of the wall in a direction out of the plane of the wall, the hinge being mountable on said one side of the wall and door so as not to extend beyond the surfaces of the door and the wall on the other side of the wall.

A hinge in accordance with the present invention allows forces which are applied to the door to be transferred onto the wall support member, thereby reducing the risk of the door bursting from its hinges. Two or more such hinges may be used to fix the door to an adjacent wall and they may be provided sufficiently close together to ensure that the door will not bend between its hinges to any significant extent. The door may be made of any suitable material, for instance, glass or other clear plastics material (eg perspex or acrylic). The wall may also be made of the same or other more solid materials, for instance, brick.

The wall support member may be made of, for instance, glass, steel, wood, aluminium or concrete.

Preferably the length of said third portion is at least one tenth the length of said second portion. In one embodiment, the length of the third portion is approximately two fifths the length of the second portion.

Preferably the second portion comprises a wall abutting part and, extending therefrom, a part mating with said first portion. Preferably said third portion of the hinge is at least half the length of said wall abutting part. In one embodiment the length of the third portion is two thirds the length of the wall abutting part.

Preferably said third portion is of a width substantially the same as that of said first and second portions or either of them.

Preferably the thicknesses of the parts of all three portions that are in contact with the surface of the wall, the door, or the wall support member are all approximately the same and of a comparable thickness to that of the wall, the door and/or the wall support member. More preferably a strengthening rib of greater thickness runs along said second portion to the third portion.

Preferably the pivotal axis of the hinge should be, when fitted, substantially parallel to, and positioned between, the vertical edges of said door. More preferably the door is provided with a cutout portion extending inwardly from one vertical edge and the hinge is positioned so that the pivotal axis lies between the sides of said cutout portion. The pivotal axis may lie within the cutout portion or outside the plane of an exterior surface of the door. Thus in a preferred embodiment the pivotal axis is positioned close to, but not on, the edge of the door nearer to that adjacent wall to which the hinge is connected. When the door is opened in a direction into the games court, a heel portion of the door swings outwards. A door stop placed outside the court may limit the movement of the heel portion and the extent of opening of the door may be restricted in this way. Alternatively, a stop integral with or attached to the hinge, but not intruding into the area of play, may be provided. Preferably there is allowed some degree of movement of the door in the opposite direction to that in which the door opens.

The present invention also provides a wall for a games court, the wall including a door which is fixed to the remainder of the wall by means of hinges according to the invention.

Furthermore, the present invention provides a games court including at least one wall according to the invention.

An embodiment of the present invention will now be described, by way of example only, and with reference to the accompanying drawings, in which.

Figure 4:
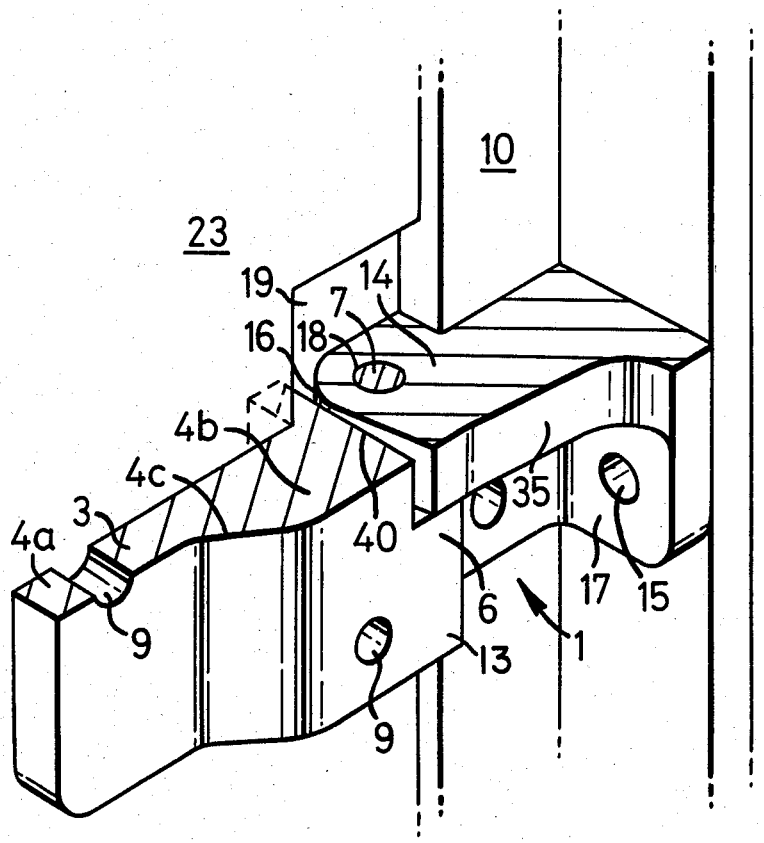
FIG. 4 is a perspective view of a section through the hinge of FIG. 1 when fitted to a games court glass door and adjacent glass wall.

Referring to FIG. 4 of the accompanying drawings, a games court may be, for instance, a squash court having a rear wall 10 made of glass. Rear wall 10 includes a glass door 23 and one or more wall support members in the form of glass fins extending a short distance outwardly from wall 10 and arranged in a vertical plane. Each wall support member is fixed to wall 10 by means of brackets (not shown).

The door 23 is provided with two vertically spaced apart rectangular cutout portions 19, each cutout portion 19 extending inwardly from one vertical edge of door 23.

Associated with each cutout portion 19 is a door hinge 1. Door hinge 1, which is in accordance with the present invention, comprises a first portion 3 fixed to the door 23 and a second portion 5 fixed to the wall 10. Integral with and extending at right angles to the second portion 5 is a third portion 17 which is fixed to wall support member.

Referring to FIGS. 1 to 4 the first portion 3 of hinge 1 includes a portion 4 substantially rectangular in front elevation which abuts the exterior surface of door 23.

Figure 2:
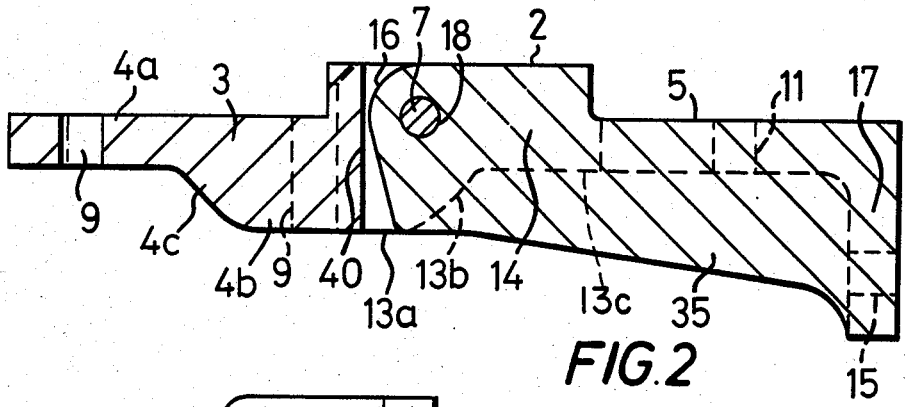
FIG. 2 is a top plan of the door hinge of FIG. 1.
Figure 3:
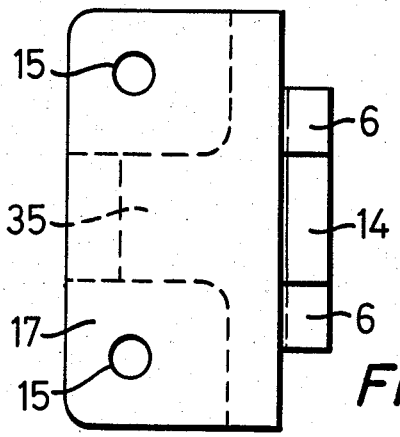
FIG. 3 is an end elevation of the door hinge of FIG. 1.

The portion 4, in top plan view, as best seen in FIGS. 2 and 4, is of a varying thickness. The part 4*a*, the most remote part from the door edge of the portion 4, is of a comparable thickness to that of the door 23 itself. However, part 4*b* of the portion 4, lying nearest the door edge, is of approximately twice the thickness of part 4*a*. Both part 4*a* and part 4*b* have substantially planar front surfaces which extend substantially parallel to the plane of the door 23.

An intermediate inclined part 4*c* lies between parts 4*a* and 4*b*. The thickness of the part 4*c* varies substantially linearly from a thickness equal to that of part 4*a*, to one equal to that of part 4*b*, and so presents a substantially smooth transition from part 4*a* to part 4*b*. Extending through the rectangular portion 4 are screw holes 9 so that this portion 3 of the hinge may be fixed, by means of screws, to the door 23.

Portion 3 also includes a bifurcated portion 6 which is of a thickness approximately three times that of the part 4*a* of the portion 3, and of a length approximately equal to the depth of the cutout portion 19 of the door 23. Bifurcated portion 6 substantially fills cutout portion 19 apart from the space between the arms of this portion.

The rear face 2 of the bifurcated portion 6 is substantially planar with the inner face of the door 23.

The front face 13 of the portion 6 is, in the region 13*a*, nearest the hinge part 4*b*, planar with the corresponding face of the part 4*b*. However, in the region 13*c* nearest the edge of the door 23, the front face 13 lies in the same plane as the corresponding face of the part 4*a* of the hinge portion 3. An intermediate inclined region 13*b* between these two abovementioned regions 13*a* and 13*c* provides a substantially smooth transition area.

Extending vertically through the upper arm of bifurcated portion 6 and also about halfway through the lower arm of said portion 6 from the upper surface thereof are bores 8 and 10 which are in vertical alignment with each other. The centres of the bores are in substantially the same plane perpendicular to the door 23 as the interface between the regions 13*a* and 13*b* of the front face 13 of the hinge portion 6.

Figure 1:
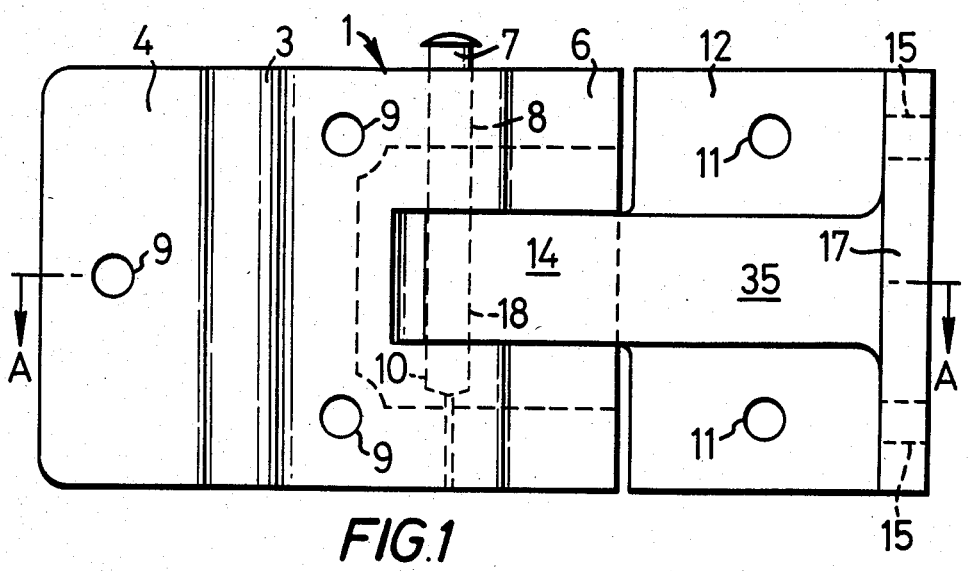
FIG. 1 is a side elevation of a door hinge in accordance with the present invention.

The second portion 5 of hinge 1 includes a rectangular portion 12 which is slightly longer than the abovementioned rectangular portion 4 but is similarly provided with screw holes 11 whereby portion 5 can be fixed to wall 10. The rectangular portion 12 is of substantially equal thickness to that of the wall 10. Extending laterally and centrally from rectangular portion 12 is a tongue 14 which has a thickness approximately three times that of rectangular portion 12 and equal to that of the region 13*a* of the bifurcated portion 6. Indeed tonge 14 is located mainly between the arms of bifurcated portion 6 and is provided with a convex end 16 which lies close to a corresponding straight surface 40 provided between the arms of bifurcated portion 6 of portion 3. Tongue 14 is also provided with a bore 18 which, as best seen in FIG. 1, is in vertical alignment with bores 8 and 10 of bifurcated portion 6. A pin 7 extends from the bottom of bore 10 through bore 18 to the top of bore 8 allowing pivotal movement between the hinge parts about the longitudinal axis of pin 7.

Bifurcated portion 6 and tongue 14 together fill substantially the whole of the cutout 19 and the arrangement is such that the door may be open, pivoting about pin 7 in a direction away from wall support member, that is to say, into the squash court. A portion of the door, a so-called heel portion, which extends between the pivot axis of the door and the edge 22 of the door, will, when the door is opened, swing outwardly, that is to say, in a direction away from the interior of the squash court. An appropriately located door stop fixed into the floor will be engaged by this heel portion of the door and so limit the maximum swing of the door, thereby avoiding the door being swung into the adjacent wall 10. In addition, the shape of the surfaces 16 and 40 of the first and second hinge portions 3 and 5 allows a small degree of movement of the door in the direction out of the squash court. This reduces the rigidity of the system so that the shock of, for instance, a player colliding with the door 23 does not break the hinge.

The third portion 17 of hinge 1 has approximately the same thickness as portions 3 and 5 where they abut door 23 and wall 10 respectively. Portion 17 has a length which is approximately two fifths the total length of the second ortion, that is to say, including tonge 14. The length of portion 17 is about two thirds of the length of the wall abutting rectangular portion 12 of portion 5. Portion 17 is provided with screwholes 15 whereby it may be fixed to wall support member. In this way forces applied to door 23, for instance, as a result of a collision of a player with the interior surface of the door may be dispersed at least partly into wall support member as well as wall 10, thereby reducing the risk of the door bursting from its hinge and/or the hinge breaking away from wall 10.

A strengthening rib 35 runs substantially longitudinally along the central region of the second hinge portion 5 from the tongue 14 to connect with the third hinge portion 17. The rib 35 has a thickness approximately equal to that of the part 12 of the hinge portion 5, at its interface with the tonge portion 14. The thickness increases substantially linearly in a direction longitudinal of the hinge 1, until at its connection with the third hinge portion 17, the thickness of the rib 35 is substantially equal to the length of the portion 17.

The rib 35 serves to transmit the shock of an impact with the door 23, and hence the hinge 1, to the third hinge portion 17, from where it can be transmitted into the wall support member.

The additional thickness of the bifurcated portion 6 and tonge 14 extends, as is best seen in FIG. 2, in a direction towards the interior of the court. The arrangement is such that the interior side surfaces of tongue 14 and bifurcated portion 6 are flush with each other and with the interior surface of door 23 and wall 10. Accordingly, no part of the hinge projects either inwardly or outwardly from the interior surface of the wall 23 and door 10 and a smooth continuous playing surface, including door 23, wall 10 and the abovementioned portions of the hinge 1, is provided.

Hinge 1 may be made of any suitable material, for instance, a transparent nylon or a suitable metal. Conveniently, the second hinge portion 5, the third hinge portion 17, and the strengthening rib 35 may be formed as an integral unit, for example by moulding from a suitable plastics material.

I claim:

1. A door and hinge assembly comprising a first portion to be fitted to the door, a second portion to be fitted to a wall adjacent to the door, said second portion being pivotally connected to said first portion to allow rotation about a pivot axis spaced inwardly along the door from the edge of the door adjacent the wall, a third portion integral with said second portion and connectable to a wall support member extending at one side of the wall in a direction out of the plane of the wall, the hinge being mountable on said one side of the wall and door so as not to extend beyond the surfaces of the door and the wall on the other side of the wall, wherein the first portion of the hinge has arms defining a bifurcated portion receiving a tongue extending from the second portion thereof, and wherein said hinge is adapted, so that when fitted, said bifurcated portion and the tongue together substantially fill a cut-out portion provided in the door and being substantially flush with the interior face of the door, the cut-out portion extending inwardly from one vertical edge of the door, the tongue having a convex end which lies close to a corresponding straight surface of the first portion provided between the arms defining the bifurcated portion to allow movement of the door edge adjacent the wall out of the plane of the wall when the door is opened.

2. An assembly according to claim 1 wherein said third portion of the hinge is up to half the length of said second portion.

3. An assembly according to claim 2 wherein the length of said third portion is about two fifths the length of said second portion.

4. The assembly according to claim 1 wherein the second portion comprises a wall abutting part and, extending therefrom, the part mating with said first portion.

5. An assembly according to claim 4 wherein said third portion of the hinge is about two thirds the length of said wall abutting part.

6. An assembly according to claim 1 wherein the third portion is of a width substantially the same as that of said first and second portions or either of them.

7. The assembly according to claim 1 wherein the thickness of the parts of all three portions that are in contact with the surface of the wall, the door, or the wall support member are all approximately the same and of a comparable thickness to that of the wall, the door and/or the wall support member.

8. An assembly according to claim 1 wherein the pivotal axis of the hinge is substantially parallel to, and positioned between the vertical edges of said door.

9. An assembly according to claim 1 adapted so that the pivotal axis of the hinge lies between the sides of the cut-out portion provided in the door.

* * * * *